US005208640A

United States Patent [19]

Horie et al.

[11] Patent Number: 5,208,640

[45] Date of Patent: May 4, 1993

[54] IMAGE RECORDING APPARATUS

[75] Inventors: Kiyoshi Horie; Toshiaki Yajima; Hiroshi Ishikawa; Akira Ogita, all of Kanagawa, Japan

[73] Assignee: Fuji Xerox Co., Ltd., Tokyo, Japan

[21] Appl. No.: 610,250

[22] Filed: Nov. 8, 1990

[30] Foreign Application Priority Data

Nov. 9, 1989 [JP] Japan ..... 1-291717

[51] Int. Cl.[5] ..... G03G 21/00

[52] U.S. Cl. ..... 355/321; 271/9; 271/298; 271/301; 355/200

[58] Field of Search ..... 346/44; 355/46, 200, 355/309, 313, 308, 321, 319; 361/391, 394; 271/3, 9, 65, 298, 301, 303

[56] References Cited

U.S. PATENT DOCUMENTS

| | | | |
|---|---|---|---|
| 4,587,532 | 5/1986 | Asano | 346/441 X |
| 4,591,884 | 5/1986 | Miyamoto et al. | 355/319 X |
| 4,918,490 | 4/1990 | Stemmle | 271/301 X |
| 4,972,236 | 11/1990 | Hasegawa | 355/313 X |
| 5,052,671 | 10/1991 | Matsuo | 271/9 |

*Primary Examiner*—Joan H. Pendegrass
*Assistant Examiner*—P. Stanzione
*Attorney, Agent, or Firm*—Finnegan, Henderson, Farabow, Garrett & Dunner

[57] ABSTRACT

An image recording apparatus including a plurality of recording modules for substantially simultaneously recording on recording sheets images according to image data supplied thereto, an image data supplier for supplying images to the recording modules, a sheet supplier for supplying the recording sheets to the recording modules, and sheet distributors for distributing the recording sheets thus supplied successively by the sheet supplier to the recording modules.

3 Claims, 15 Drawing Sheets

SEL SIGNAL
IMAGE DATA FORMING DEVICE
100
D
CF
GATE CKT
120
SPLIT CKT
131
Ds
Dm
FIRST SG
SECOND SG
132
133
Cs
Cm
FIFO
GAP MEM.
134
135
FIRST ROS CONT.
SECOND ROS CONT.
136
137
LASER DRIVER
143
144
FIRST LASER
SECOND LASER
141
142
130a (130)
130b
130c
40a
40b
40c

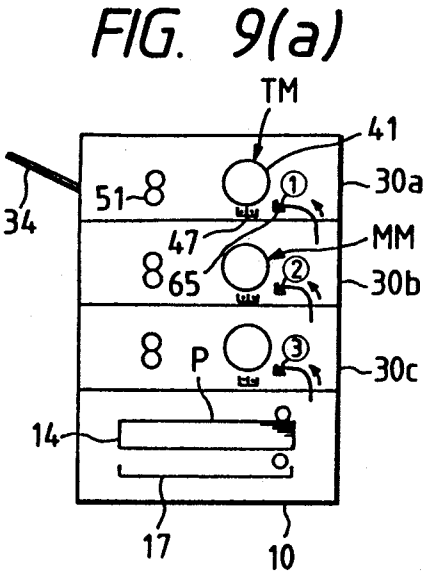
FIG. 9(a)
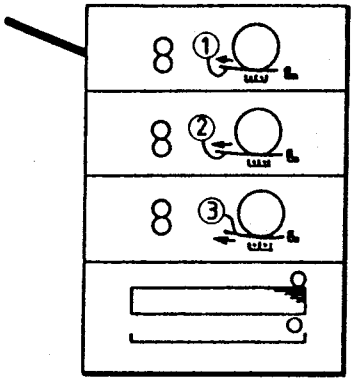
FIG. 9(b)
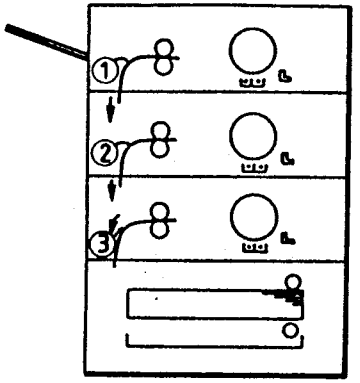
FIG. 9(c)
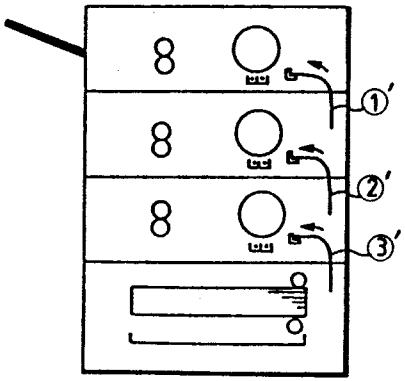
FIG. 9(d)
FIG. 9(e)
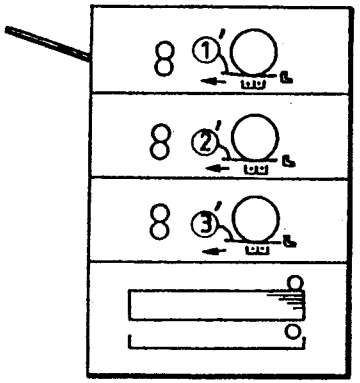
FIG. 9(f)

IMAGE RECORDING APPARATUS

BACKGROUND OF THE INVENTION

1. Field of the Invention

This invention relates to image recording apparatus such as a printer and a copying machine, and more particularly to a novel image recording apparatus which is improved in recording speed, thus being effective in performing an image recording operation taking a relatively long time.

2. Description of the Related Art

One example of the conventional image recording apparatuses is a color copying machine which has been disclosed, for instance, by Japanese Patent Application Publication No. 20579/1980.

In the copying machine, a plurality of different developing units having different color developing agents are arranged around its photo-sensitive drum. As the photosensitive drum rotates, the latent images on the photosensitive drum are developed successively with the respective developing agents, and the images thus developed are transferred on a transfer roller in an overlap mode to form a full-color image, which is transferred onto the recording sheet.

With the image recording apparatus of this type, in order to obtain one color copy, it is necessary to rotate the photosensitive drum several turns. Hence, the apparatus suffers from the difficulty that its copying speed is much lower than that in the ordinary black and white copying operation.

In order to overcome this difficulty, it is necessary to increase the speed (process speed) of the photo-sensitive drum; however, an increase of the process speed is limited to the image forming process.

Under this condition, the color copying capability may be improved, for instance, by the following method: A plurality of color copying machines are operated simultaneously to print a plurality of recording sheets using one and the same original. In this case, the color copying capability can be increased as much as the number of copying machines.

However, the method is disadvantageous in the following points: Since it is necessary to install a plurality of color copying machines, the installation space is increased as much. Furthermore, since the color copying machines have their own sheet supply trays, it is necessary to perform the following troublesome operations: It is necessary to detect whether or not recording sheets are in the sheet supply trays of the color copying machines, to detect the number of recording sheets in each sheet supply tray, and to detect the kind of recording sheets (whether the recording sheets are ordinary ones or whether they are OHP sheets, for instance). In the case of using recording sheets having page numbers, the groups of recording sheets having predetermined page numbers must be set in the respective sheet supply trays of the color copying machines. Thus, it is essential to manage the recording sheets individually and separately.

In the apparatus, the recording sheets are supplied from the different sheet supply trays, and therefore the amount of positional shift (lateral shift in registration) of the recording sheet from the image on the photo-sensitive drum depends on the color copying machine; that is, different color copying machines provide different amount of positional shift. Hence, in this case, the images printed by the copying machines are greatly different in position. Thus, in this case, the positions of the sheet supply trays must be adjusted all over again.

The above-described technical difficulties are significant particularly in color image recording operations; however, it can be said that the same difficulties occur with the ordinary black and white image recording operations.

SUMMARY OF THE INVENTION

In view of the foregoing, an object of this invention is to provide an image recording apparatus in which, with the premise that the image forming process speed is limited, both the unwanted increase of the installation area and the troublesome management of the recording sheets are avoided, and the image recording capability per unit of time is substantially increased.

An image recording apparatus according to the invention, as shown in FIG. 1, comprises: a plurality of recording modules 1 (more specifically, 1*a*, 1*b* and 1*c*) for recording images according to supplied image data (Im) on recording sheets P substantially simultaneously in a parallel mode; image data supplying means 2 for supplying one and the same image or different images to the recording modules 1 (1*a*, 1*b* and 1*c*); sheet supplying means 3 for supplying the recording sheets P to the recording modules 1 (1*a*, 1*b* and 1*c*); and sheet distributing means 4 for distributing the recording sheets P thus supplied successively by the sheet supplying means 3 to the recording modules 1 (1*a*, 1*b* and 1*c*).

In order to improve the collection of the printed recording sheets P, it is preferable that, as indicated by the phantom lines in FIG. 1, sheet collecting means 5 for delivering the printed recording sheets P successively into a predetermined sheet discharge section is provided in addition to the above-described recording modules 1 (1*a*, 1*b* and 1*c*), image data supplying means 2, sheet supplying means 3 and sheet distributing means 4.

In the above-described apparatus, the recording modules 1 may be image forming devices which form images by electrophotographing, or image recording devices which record images by heat-sensitive recording, or by ink jet-recording. The number of recording modules 1 may be suitably determined from the size of the image recording apparatus and the recording speed required. Furthermore, as for its image forming system, a full- color overlap recording system, a plural-color individual recording system, or a monochromatic recording system may be employed. For fine control of the recording modules 1, it is desirable that the recording modules 1 are operated with the same image recording timing; however, the recording modules may be somewhat different in image recording timing. For instance, in a full-color overlap recording operation, the recording modules 1 may be different in image recording timing as much as one to three revolutions of the photo-sensitive drum.

The above-described image data supplying means 2 may be a device which forms image data Im using image signals which are provided by reading an original, or a device which uses data stored in a recording medium or data transferred from the host computer to form image data Im. In this case, the density level of the image data Im may be of multi-gradation, or two-valued. And in the case of color image data Im, the density data may be provided for each color, or it may be added with color data.

One and the same image data Im, or different image data Im may be applied to the recording modules 1.

In the case where one and the same image data Im is applied to the recording modules 1, the image data supplied by the image data supplying means 2 is of one page. Therefore, the recording modules 1 can be made substantially coincident in image recording timing with one another by serially expanding the supplied image data Im successively in the recording modules 1. In the case where, on the other hand, the image data Im applied to the recording modules 1 are different, the image data Im supplied from the image data supplying means 2 are of pages corresponding to the number of recording modules 1. Hence, in order to make the recording modules 1 substantially coincident in image recording timing with one another in the apparatus in which image data Im are supplied in a serial mode by the image data supplying means 2, the apparatus should be designed as follows: The supplied image data Im are stored in the page memories in the recording modules 1, and thereafter in each recording module 1 the supplied image data Im is serially expanded. In the apparatus in which the image data supplying means 2 supplies image data Im of plural pages in a parallel mode, the recording modules 1 can be made coincident in image recording timing with one another by serial expansion of the image data Im by each recording module.

The speed of supply of recording sheets P from the sheet supplying means 3 should be determined to meet the amounts of supply of recording sheets P to the recording modules 1 which are determined by taking into account the image record process speeds of the recording modules 1 and the conveyance paths to the recording modules 1. In this connection, it should be noted that, in each recording module, the speed of supply of recording sheets P is set much higher than the image record process speed.

With respect to the above-described sheet supplying means 3, the kind of recording sheets P handled thereby or the construction of the sheet supply section may be changed as long as it can supply recording sheets P one after another. In this case, in order to increase the number of kinds of recording modes in each recording module 1, it is preferable to provide an intermediate sheet supply section which, in a both-side record mode, turns over the recording sheets P the first sides of which have been recorded by the recording modules 1 and accommodates the recording sheets P thus turned over, and supplies the recording sheets thus accommodated to the recording modules again, and to provide sheet returning means for conveying, in the both-side record mode, the recording sheets P the first sides of which have been recorded by the recording modules 1 to the intermediate sheet supply section.

The position of the sheet supplying means 3 is not particularly limited. However, in order to minimize the installation space of the apparatus, it is preferable that the recording modules 1 and the sheet distributing means 4, or these units 1 and 4 and the sheet collecting means 5 are set on the sheet supplying means 3.

In order to prevent the jamming of recording sheets, or in order to successively distribute recording sheets P from the sheet supplying means 3 to the recording modules 1, branch paths may be provided which are extended from the common conveyance path to the recording modules 1, with change-over gates provided at the branching points of the branch paths from the common conveyance path; or exclusive conveyance paths may be connected to the recording modules 1, respectively, with path change-over means for selecting a predetermined one of the exclusive conveyance paths.

In the case where the former system is employed, the recording sheet conveyance paths can be simplified in arrangement; however, in order to positively distribute the recording sheets to the respective recording modules using the change-over gates at the branching points, it is necessary to accurately adjust the gap between adjacent recording sheets P at the branching points; that is, it is necessary to control the conveyance of recording P with high accuracy. On the other hand, in the case where the latter system is employed, the recording sheets P are conveyed to the recording modules through the exclusive conveyance paths, respectively, and therefore the sheet conveyance paths are rather intricate in arrangement; however, preferably the recording sheets P can be positively delivered to the respective recording modules even if the gap between adjacent recording sheets P is not so accurately controlled.

The sheet collecting means 5 may be freely modified so as to deliver the recording sheets 1 from the recording modules 1 to the predetermined sheet discharge section. The position of the sheet discharge section is not limited; however, in view of the collection of the recording sheets P printed, the sheet discharge section should be positioned relatively low.

The recording modules 1, the sheet distributing means 4, and the sheet collecting means 5 may be individually arranged; however, in order to simplify the construction of the apparatus or to change the specification of the apparatus (for instance increasing the number of recording modules 1) with ease, it is preferable to employ the following method: The sheet distributing means 4, or the sheet distributing means 4 and the sheet collecting means 5 are divided into divisional parts made up of the same components in correspondence to the number of recording modules 1, so that the divisional parts and the recording modules are combined into recording units which are equal in arrangement.

In the case where the recording modules are of electrophotographing type, fixing means for fixing toner images is employed. In order to reduce the power consumption, the apparatus may be so modified that one and the same fixing means is used for all of the recording modules 1.

In the above-described apparatus, image data Im are applied to the recording modules 1 by the image data supplying means 2.

On the other hand, the recording sheets P supplied from the sheet supplying means 3 are delivered through the sheet distributing means 4 to the recording modules 1, respectively.

Under this condition, images according to the image data Im received are recorded on the recording sheets P by the recording modules 1 substantially simultaneously, and the recording sheets P thus recorded are delivered to the predetermine sheet discharge section by the sheet collecting means 5.

BRIEF DESCRIPTION OF THE DRAWINGS

FIGS. 9(*a*) through 9(*f*) are simplified explanatory diagrams for a description of the operation of a both-side print mode.

DETAILED DESCRIPTION OF THE PREFERRED EMBODIMENTS

Preferred embodiments of this invention will be described with reference to the accompanying drawings.

First Embodiment Contents

I. Outline of the Apparatus
II. Components of the Apparatus
(1) Sheet supplying unit
(2) Recording unit
III. Apparatus Control System
(1) Apparatus control block diagram
(2) Image data supply control system
(3) Sheet conveyance control system
3-a) One-side print mode
3-b) Both-side print mode
IV. Modifications I. Outline of the Apparatus In an embodiment shown in FIG. 2, the technical concept of this invention is applied to a printer which is an image output terminal (hereinafter referred to merely as "an IOT", when applicable) provided separately for an image data supplying device which forms image data using the image signal of an image input terminal (hereinafter referred to merely as "an IIT", when applicable) which is adapted to read an original.

Figure 1:
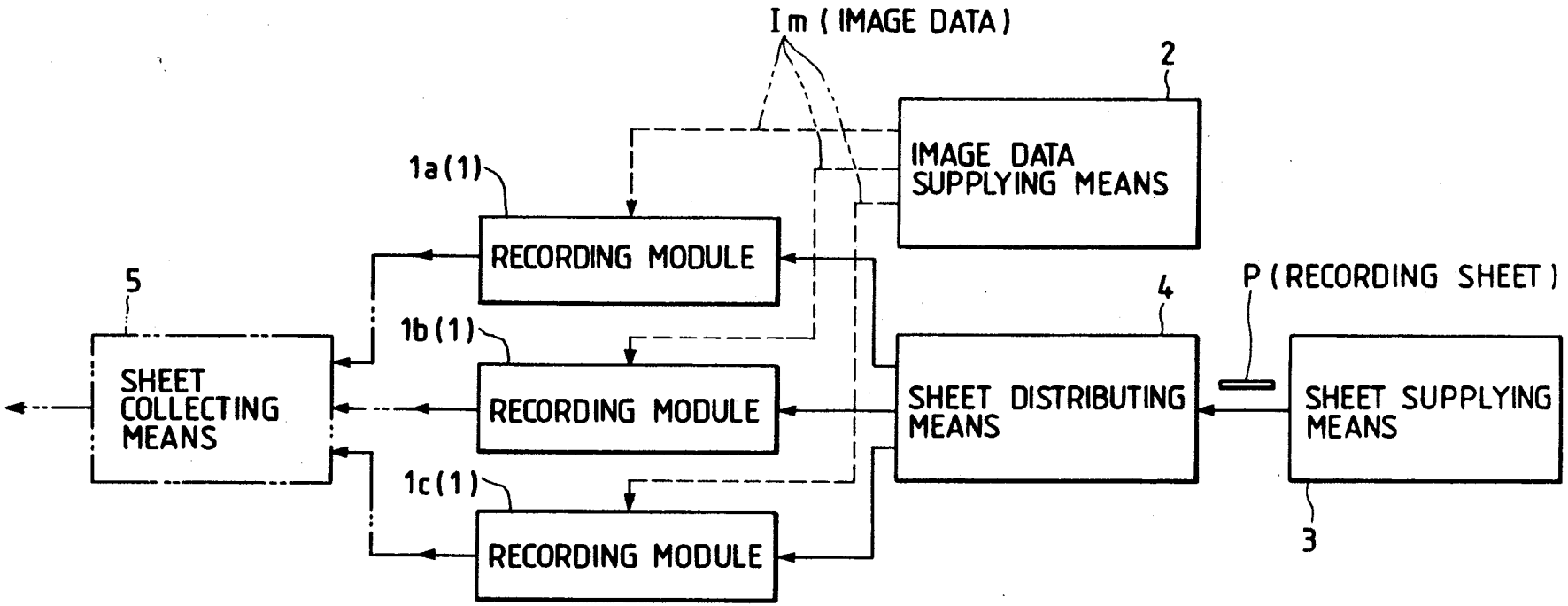
FIG. 1 is an explanatory diagram outlining the arrangement of an image recording apparatus according to this invention.
Figure 2:
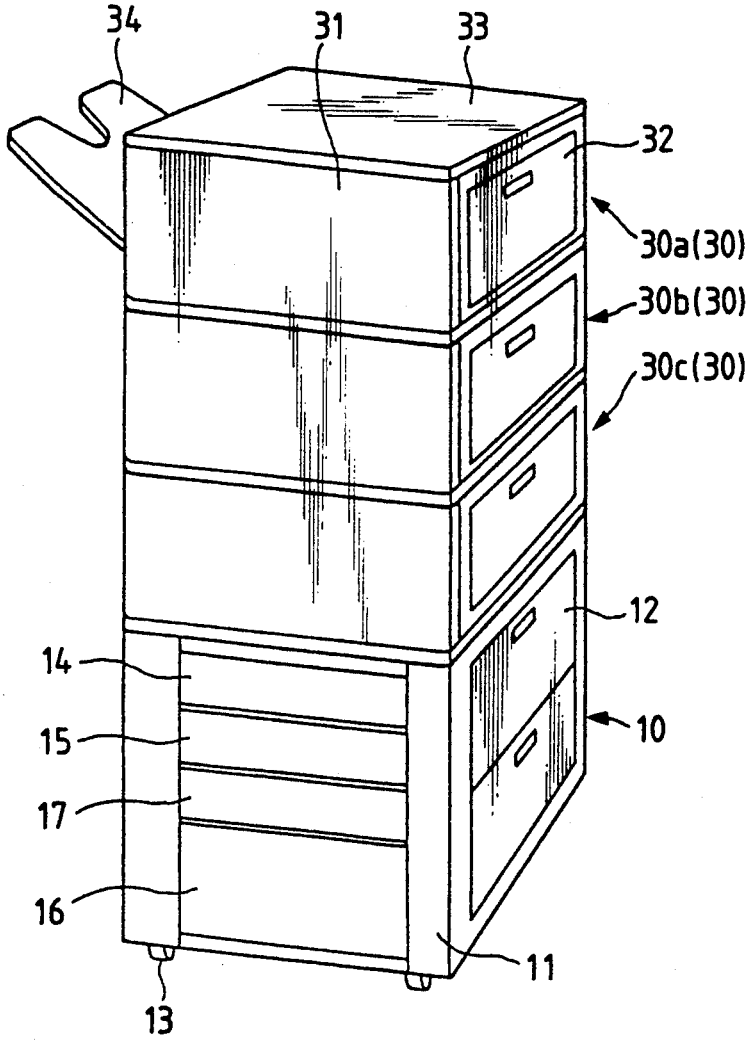
FIG. 2 is a perspective view showing the external appearance of a printer constructed according to a first embodiment of the invention.

In FIG. 2, reference numeral 10 designates a sheet supplying unit which accommodates recording sheets P to be supplied (hereinafter referred to merely as "sheets P", when applicable). A three-tiered record unit 30 (or three record units 30*a* through 30*c*) is mounted on the sheet supplying unit 10. Doors 12 and 32 are provided for the housing 11 and the housings 31 of the record units 30, respectively, so that the recording sheets P can be removed when jammed. Further in FIG. 2, reference numeral 33 designates a top cover placed on top of the uppermost record unit 30*a*; and 34, a discharge tray for discharging a recorded recording sheet P.

II. Components of the Apparatus (1) Sheet supplying unit

The sheet supplying unit 10 is freely movable with casters 13 mounted on the bottom of the housing 11. Two sheet supply cassettes 14 and 15 each having an ordinary or standard capacity, an intermediate tray 17 for temporarily receiving a recording sheet P on one side of which recording has been made in the both-side record mode or in the one-side record mode, and a sheet supply cassette 16 having a large capacity are positioned in place in the housing 11 in the stated order from above.

Figure 3:
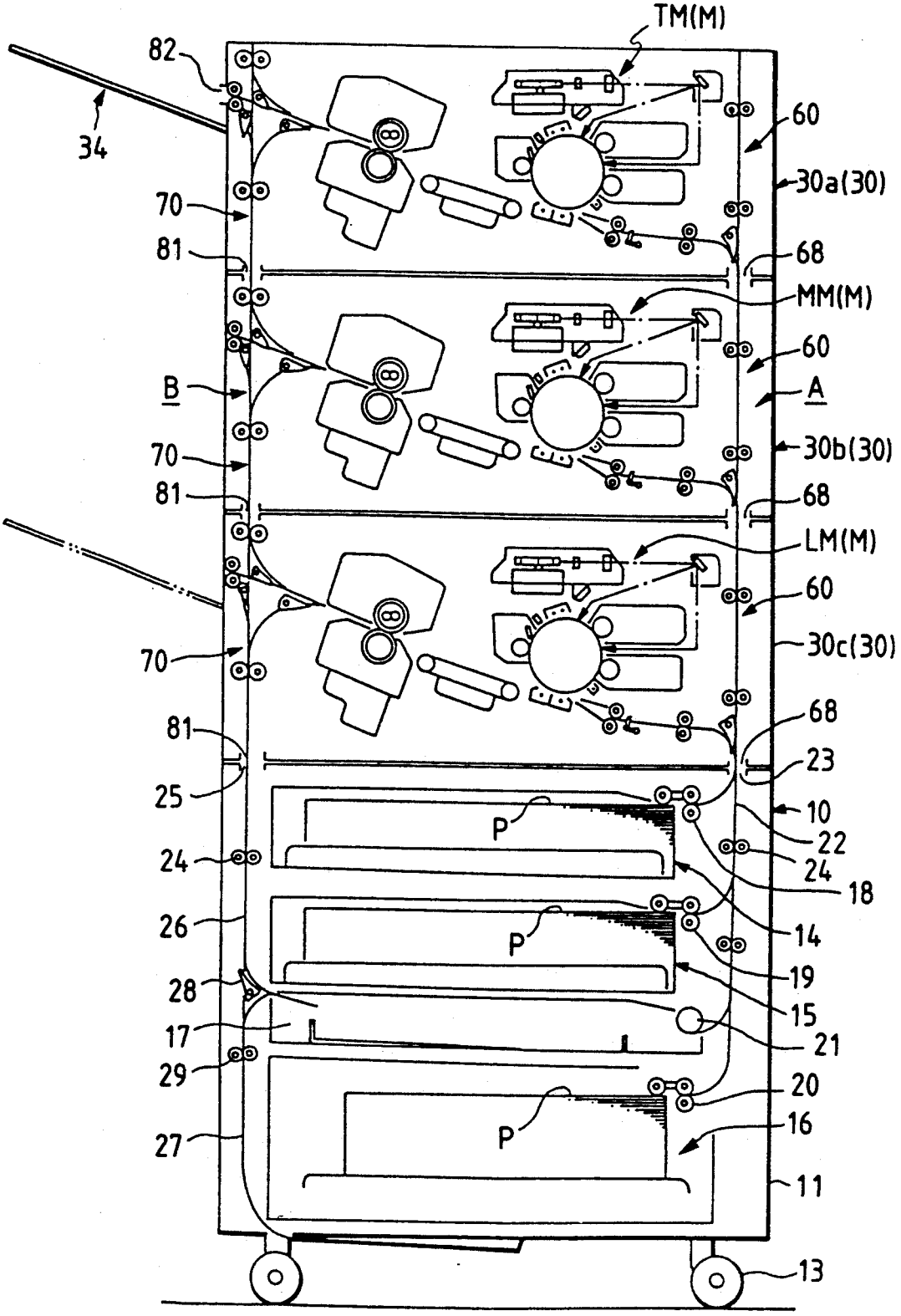
FIG. 3 is a sectional view showing the arrangement of the printer of the first embodiment of the invention.

As shown in FIG. 3, feed rollers 18 through 21 are provided at the outlets of the sheet supply trays 14 through 16 and intermediate tray 17, respectively, and a sheet supplying path 22 is extended upwardly from the outlets of the sheet supply tray 14 through 16 and the intermediate tray 17 to the sheet supply opening 23 formed in the housing 11. A plurality of pairs of conveying rollers 24 are provided along the sheet supply path.

In the housing 11, a sheet return path 26 is provided on the side (the left side in FIG. 3) opposite to the side where the sheet supply path 22 is formed, in such a manner that it is extended from a sheet return opening 25 provided in the upper portion of the housing 11 to the inlet of the intermediate tray 17. A sheet turn-over path 27 is branched from the sheet return path 26 near the intermediate tray 17. A change-over gate 28 is provided at the branching point of the sheet turn-over path 27 and the sheet return path 26 so as to allow the sheet to travel a selected path. For instance, a pair of conveying rollers 24 are provided along the sheet return path 26, and a pair of conveying rollers 29 for turning over sheets are provided along the sheet turn-over path 27.

(2) Record Unit

Figure 4:
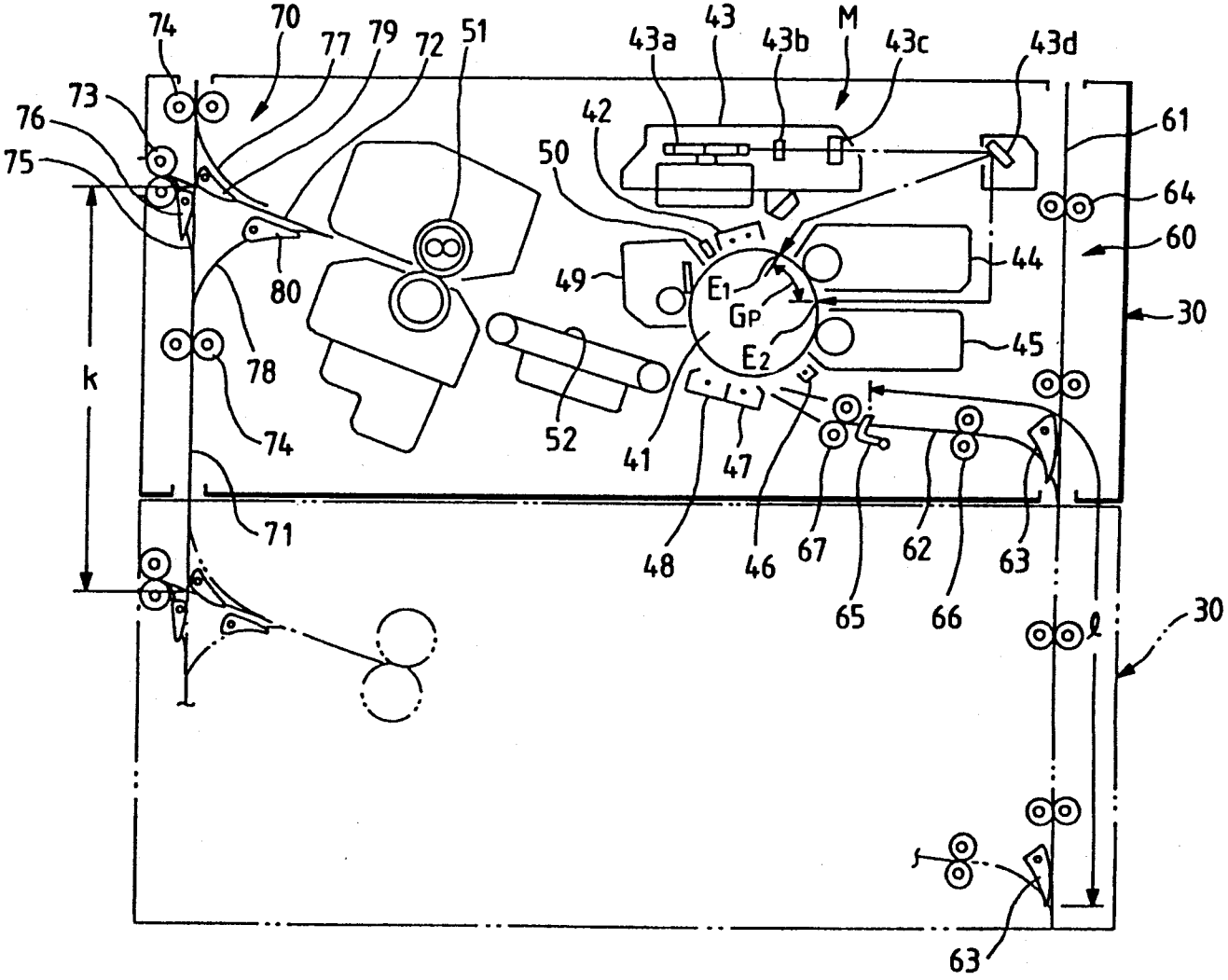
FIG. 4 is an explanatory diagram showing a recording unit of the printer.

Each record unit 30, as shown in FIGS. 3 and 4, is made up of a recording module M (or a top module TM, a middle module MM, or a low (bottom) module LM) which employs an electrophotographing process to form a two-color image by one passage of a recording sheet; a sheet-supply-side divisional conveyance system 60 for conveying the recording sheet P delivered from the sheet supplying unit 10 to its record module M or to another record module M; and a sheet-discharge-side divisional conveyance system 70 for conveying the recorded recording sheet P as required.

In the above-described embodiment, the components of each record mode will be described.

As shown in FIG. 4, the recording unit of the first embodiment includes a photo-sensitive drum 41; a charging corotron 42 for charging the photo-sensitive drum 41 in advance; a ROS (raster output scanner) 43 which is designed as follows: The output laser beams of two lasers (not shown) are deflected by a polygon mirror 43*a* in the direction of scan. The laser beams thus deflected are applied through an f$\theta$ lens 43*b* for correcting distortion in the direction of scan, a cylindrical lens 43*c* for correcting the inclination of the polygon mirror 43*a*, and a mirror unit 43*d* to deflect the laser beams to a first exposure position E1 and a second exposure position E2 on the photo-sensitive drum 41. In the embodiment, the first laser constitutes an image exposing system for exposing an image region, and the second laser constitutes a background exposing system for exposing a non-image region.

Further in FIG. 4, the recording unit also includes a first developing unit 44 for reversely developing a first negative latent image using sub-color toner (red toner for instance) which is formed by the first beam; a second developing unit 45 for normally developing a second positive latent image using main-color toner (black toner for instance) which is formed by the second beam; a transfer pretreatment corotron 46 for making the toner image on the photo-sensitive drum uniform in polarity; a transfer corotron 47 for charging the recording sheet P so that the toner image is transferred from the drum 41 onto the recording sheet P; a detach corotron 48 for discharging the recording sheet P after the image transferring operation, to separate the latter from the photo-sensitive drum 41; a cleaner 49 for removing the toner from the photo-sensitive drum 41; a discharging lamp 50 for discharging the photo-sensitive drum 41; a heat roll type fixing unit 51 for fixing the toner image on the recording sheet which has been transferred onto the latter in the above-described manner; and a conveying belt 52 for conveying the recording sheet P, to which a toner image has been transferred, to the fixing unit 51.

Now, the arrangement of the sheet-supply-side divisional conveyance system 60 will be described.

In FIGS. 3 and 4, the apparatus includes a common conveyance path 61 extended vertically in such a manner that it is communicated with the sheet supply opening 23 of the sheet supplying unit 10; a sheet distribution path 62 extended from the lower end of the common conveyance path 61 to the image transferring region of its recording module M; a change-over gate 63 provided at the branching point of the sheet distribution path 62 from the common conveyance path 61 to select a targeted path; pairs of conveying rollers 64 arranged along the common conveyance path 61; a register gate 65 disposed on the sheet distribution path 62 near the image transferring region, for controlling the timing of the recording sheet's movement into the image transferring region; a pair of conveying rollers 66 arranged along the sheet distribution path 61, the conveying rollers 66 adapted to convey each recording sheet P and to slightly curve the recording sheet P when detained at the register gate 65, so as to merely nip the recording sheet P without conveyance; and a pair of conveying rollers 67 for conveying the recording sheet P thus positioned at the register gate 65 to the image transferring region.

Communication openings 68 are formed in the bottom of the housing 31 of the top recording unit 30*a*, and in the tops and bottoms of the housings 31 of the middle and low recording unit 30*b* and 3*c* in such a manner that the openings 68 are in alignment with the sheet supply opening 23 of the sheet supplying unit 10. The sheet-supply-side divisional conveyance system 60 of the top recording unit 30*a* except the common conveyance path 61, and the sheet-supply-side divisional conveyance systems 60 of the middle and low recording unit 30*b* and 3*c* form a sheet-supply-side conveyance system A.

In the embodiment described above, as shown in FIG. 4 the conveyance path length (1) from the position of the register gate 65 of the sheet-supply-side divisional conveyance system 60 in the upper recording unit 30 (30*a* or 30*b*) to the position of the change-over gate 63 in the sheet-supply-side divisional conveyance system 60 of the lower recording unit 30 (30*b* or 30*c*) is so determined as to be longer than the length of the recording sheet P maximum in size which is curved at the register gate 65. If, in this case, the conveyance path length (1) is not long enough, then it may be provided between the recording units 30*a* and 30*c*, with the middle recording unit being bypassed.

As shown in FIGS. 3 and 4, the arrangement of the sheet-discharge-side divisional conveyance system 70 includes a common conveyance path 71 extended vertically in such a manner as to communicate with the sheet return opening 15 of the sheet supplying unit 10; a discharge conveyance path 72 extended straightly from the outlet of the fixing unit 51 towards the side board of the housing 31 of the recording unit; a pair of discharging rollers 73 arranged along the discharge conveyance path 72 near the side board of the housing 31; pairs of conveying rollers 74 arranged along the common conveyance path 71 at suitable intervals; a branched discharge conveyance path 75 extended from the point of the common conveyance path 71 which point is located below the intersection of the latter 71 and the discharge conveyance path 72 towards the discharging rollers 73; a change-over gate 76 provided at the branching point of the branched discharge conveyance path 75 from the common conveyance path 71, to select a targeted path; branch conveyance paths 77 and 78 extended upwardly and downwardly, respectively, from the discharge conveyance path 72; and change-over gates 79 and 80 provided at the branching points of the branch conveyance paths 77 and 78 from the discharge conveyance path 72, respectively, for selecting a targeted path.

As shown in FIG. 3, communication openings 81 are formed in the bottom of the housing 31 of the top recording unit 30*a*, and in the tops and bottoms of the housings 31 of the middle and low recording unit 30*b* and 3*c* in such a manner that the openings 81 are in alignment with the sheet return opening 25 of the sheet supplying unit 10.

The sheet-discharge-side divisional conveyance system 70 of the top recording unit 30*a* except the branch conveyance path 77, and the sheet-discharge-side divisional conveyance systems 70 of the middle and low recording units 30*b* and 3*c* except the branched discharge conveyance path 75 form a sheet-discharge-side conveyance system B.

In the embodiment, as shown in FIG. 4 the conveyance path length (k) between the intersection of the common conveyance path 71 and the discharge conveyance path 72 in the upper recording unit 30 and the intersection of those paths 71 and 72 in the lower recording unit 30 is made longer than the length of the recording sheet P maximum in size so that the clearance between recording sheets P is maintained with ease and the order of recording sheets P is maintained unchanged.

III. Apparatus Control System (1) Apparatus control block diagram

Figure 5:
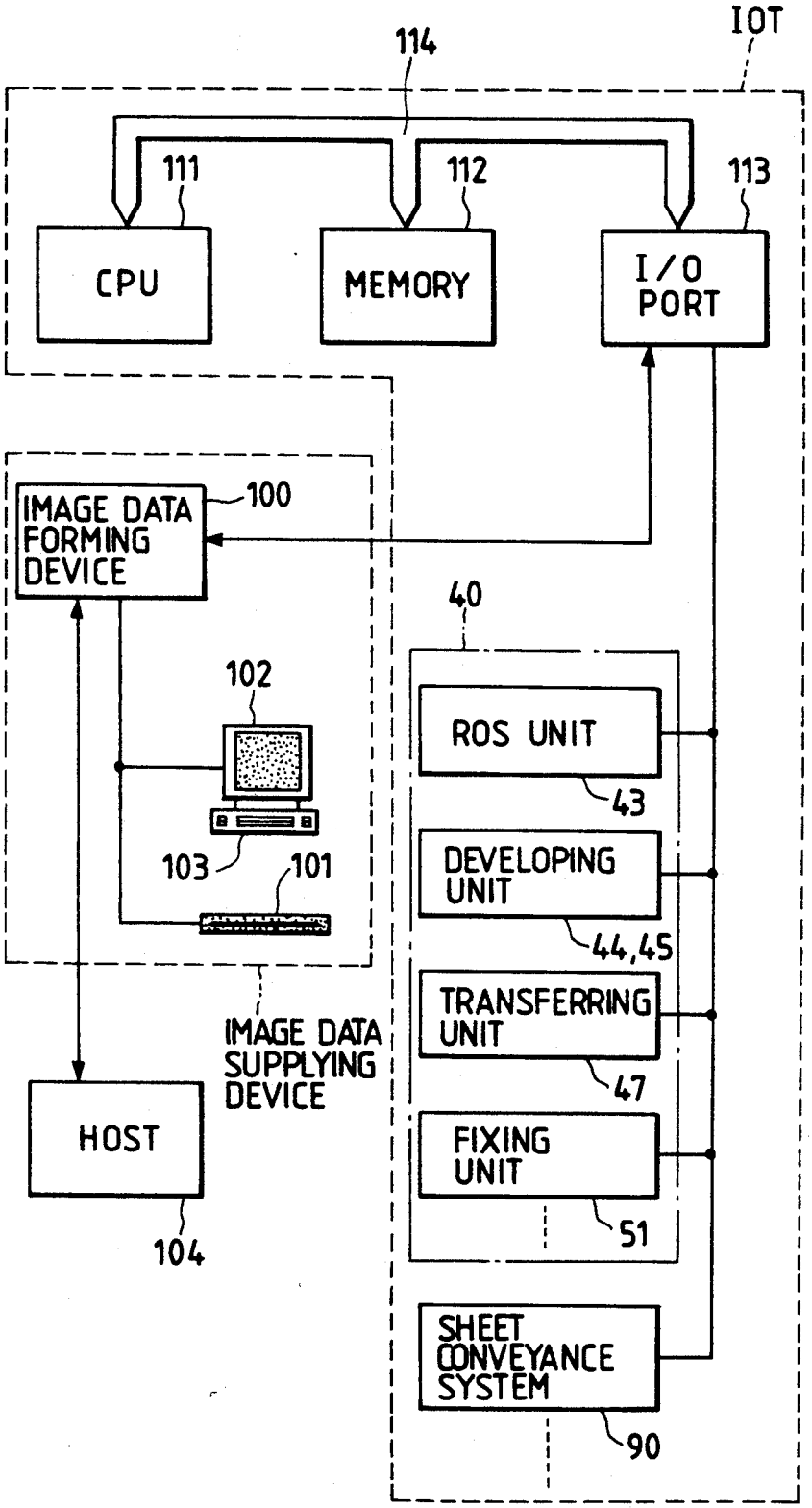
FIG. 5 is a block diagram showing a control system in the image recording apparatus.

FIG. 5 is a control block diagram of the apparatus.

As shown in FIG. 5, an image data supplying device provided separately comprises an image data forming device 100 for forming image data. The image data forming device 100 is provided with a floppy unit 101, a display unit 102, and a keyboard 103. The image data forming device 100 forms image data according to the data of the floppy disk set on the floppy unit 101, or forms image data according to the data of the floppy disk which is displayed on the display unit 102 and modified by operation of the keyboard 103, or forms image data according to data transmitted through a host computer 104 connected thereto through a communication line.

A control device for the IOT (printer) is a microcomputer system comprising a CPU 111, a memory 112, and I/0 port 113, and a system bus 114. The device transmits data to, and receives data from, the image data forming device 100 through the I/0 port 113.

In the above-described embodiment, stored in the memory 112 in advance are a recording module control program for controlling the recording operation of each recording module M (the ROS unit 43, the developing units 44 and 45, the transferring unit 47, the fixing unit 51, etc.) according to a given print mode, and a sheet conveyance control program for controlling the recording sheet P conveyance system 90 (which corresponds to the sheet supplying unit 10, the sheet-supply-side conveyance system A, and the sheet-discharge-side conveyance system B) according to a given print mode.

(2) Image data supply control system

Figure 6:
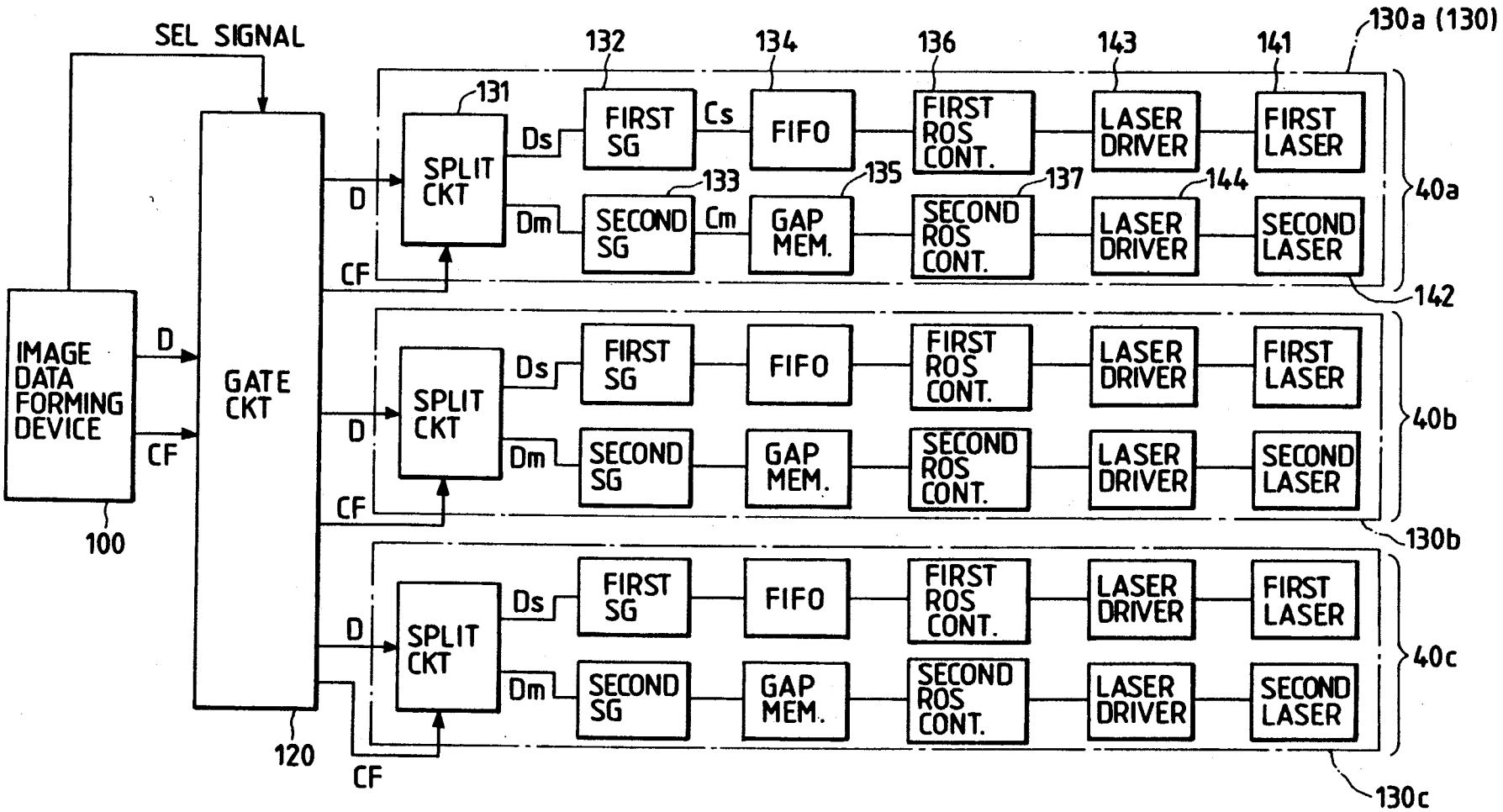
FIG. 6 is a block diagram showing the arrangement of one example of an image data supply control system.

A control system is shown in FIG. 6 in which the same image data are applied from the image data forming device 100 to the ROS units 43 of the recording modules M in a parallel mode.

As shown in FIG. 6, the image data forming device 100 outputs image data on a two-color image; that is, density data D (8-bits data for instance), and the color data of the density data D, such as for instance a color flag CF which is raised to high level in response to a sub-color region (a red region in the embodiment) and set to low level in response to the other regions which are a main-color region (a black region in the embodiment) and a background region. Furthermore, the image data forming device 100 outputs a select signal SEL (raised to high level upon requisition for printing) based on the number of sheets to be printed with the same image data.

The density data D and the color flag CF are applied to a gate circuit 120. In this case, the gate circuit 120 opens a gate for the recording modules M (TM, MM and LM) to which a printing request is given by the select signal SEL.

The gate circuit 120 is connected to three ROS control systems 130 (or 130*a*, 130*b* and 130*c*) corresponding to the recording modules TM, MM and LM, respectively.

As shown in FIG. 6, each ROS control system 130 includes a split circuit 131 for splitting the density data D outputted by the gate circuit 120 into sub-color density data Ds and main-color density data Dm according to the color flag CF; first and second screen generators 132 and 133 for converting the sub-color density data Ds and the main-color density data Dm into 3-bit density codes Cs and Cm, respectively (hereinafter referred to as "first and second SGs 132 and 133, respectively); a FIFO register 134 for read timing fine adjustment which stores the output density code Cs of the first SG 132 and then outputs it; a gap memory 135 which stores the output density code Cm of the second SG 133 for a scanning period of time corresponding to the gap Gp between the first exposure position El and the second exposure position E2 on the photo-sensitive drum 41, and then outputs it; a first ROS controller 136 for driving a first laser 142 for a first color (or a sub-color laser) through a laser driver 143 according to the density code Cs read from the FIFO register 134; and a second ROS controller 137 for driving a second laser 142 for a second color (or a main-color laser) through a laser driver 144 according to the density code Cm read out of the gap memory 135.

(3) Sheet conveyance control system

It is assumed that, in each of the following modes, the process speed is 80 mm/sec, and the speed of conveyance of a recording sheet of A4 size (laid laterally).

3-a) One-side print mode

In this mode, in all the recording modules M, an image according to one and the same data is printed on first sides of recording sheets P simultaneously.

When recording sheets P are supplied from the sheet supply cassette 14 in the order of (1), (2) and (3) with predetermined timing, as shown in the part (a) of FIG. 7 and FIG. 8 the change-over gates 63 in the sheet-supply-side conveyance system A are suitably operated, so that the firstly supplied recording sheet P (hereinafter referred to as "the recording sheet (1)", when applicable) reaches the register gate 65 in the top module TM, the secondly supplied recording sheet P (hereinafter referred to as "the recording sheet (2)", when applicable) reaches the register gate 65 in the middle module MM, and the thirdly supplied recording sheet P (hereinafter referred to as "the printing sheet (3)", when applicable) reaches the register gate 65 in the low module LM. It should be noted that these three recording sheets (1), (2) and (3) reach the respective register gates 65 at the same time.

Figure 7C:
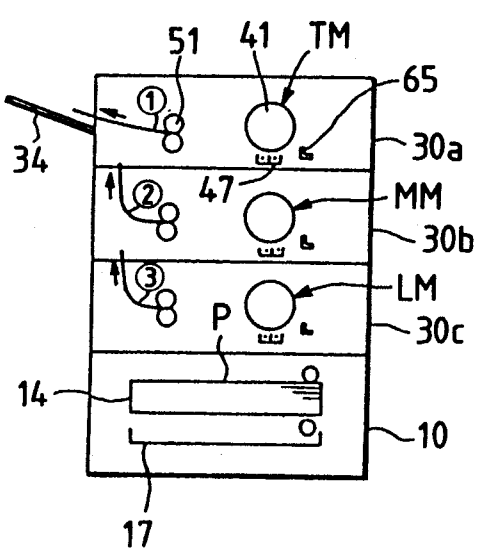
FIGS. 7(*a*) through 7(*c*) and FIG. 8 are simplified explanatory diagrams, and a timing chart, respectively, for a description of the operation of the apparatus operating in a one-side print mode.
Figure 7B:
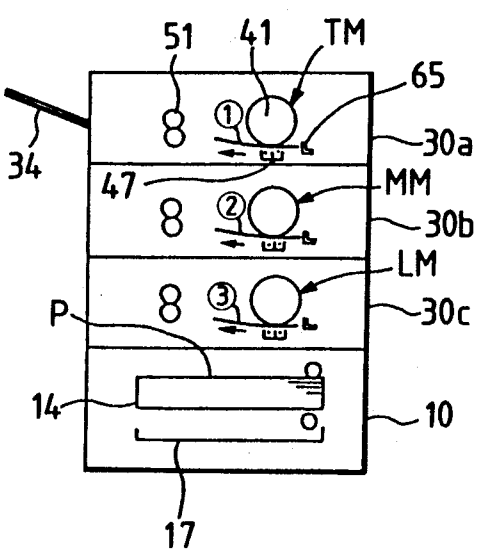
Figure 7A:
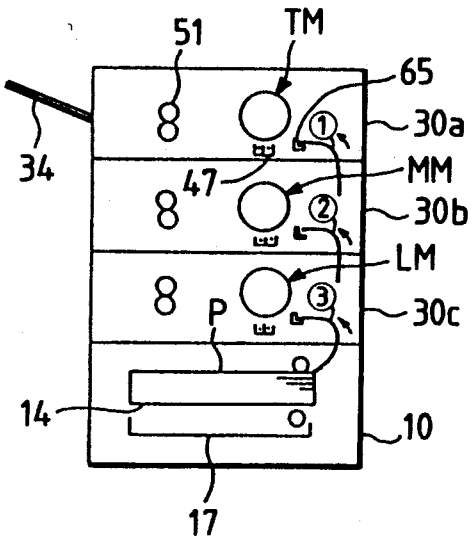
Figure 8:
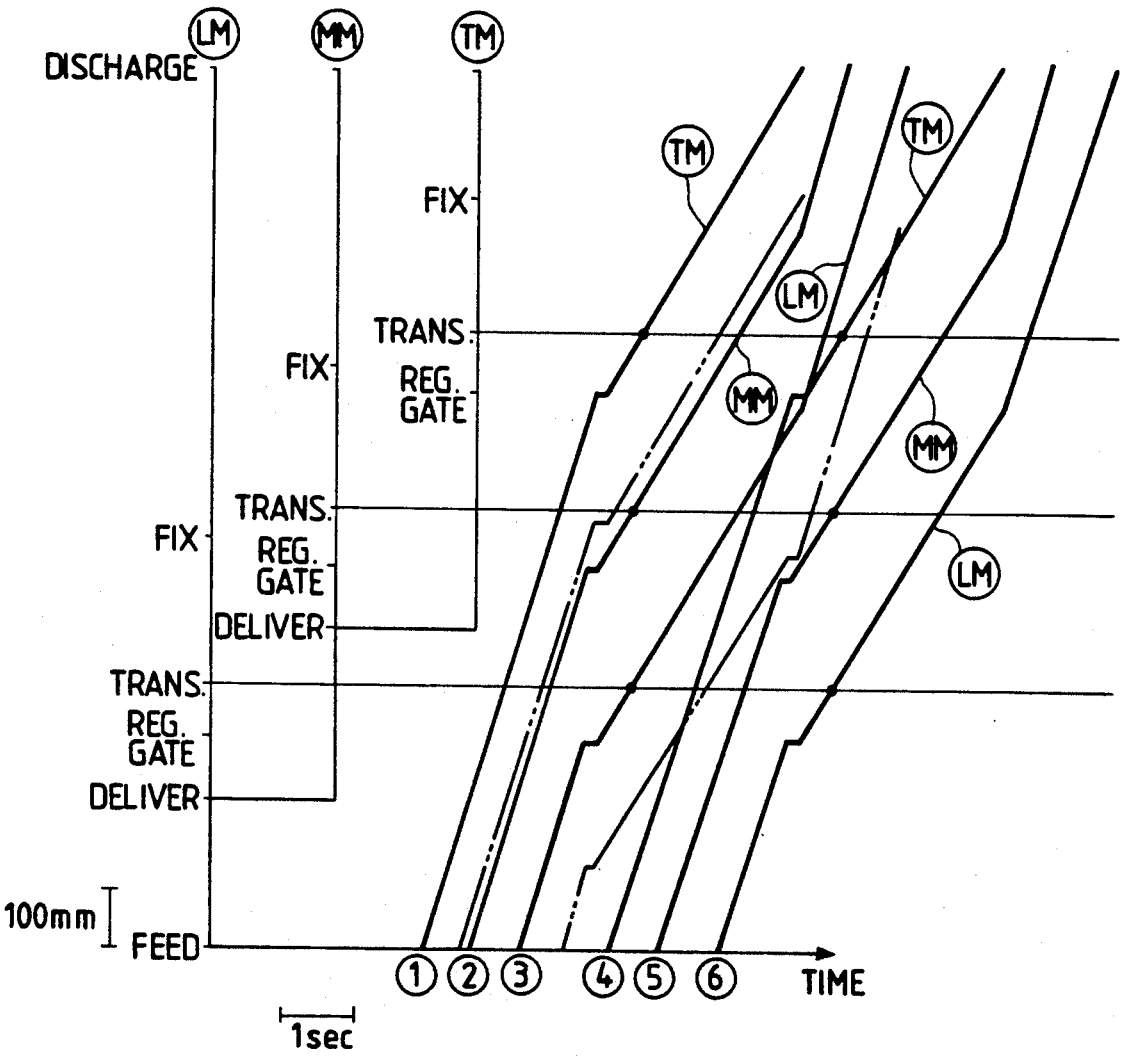

Thereafter, in the modules TM, MM and LM receiving the image data simultaneously, the same two-color toner images are formed on the photo-sensitive drums 41, and as shown in the part (b) of FIG. 7 and FIG. 8 the recording sheets (1), (2) and (3) are conveyed to the respective image transferring regions with the timing that the two-color toner images formed go through the respective image transferring regions. Thus, the image transferring operations are carried out by the transferring corotrons 47 in all the modules TM, MM and LM simultaneously.

Thereafter, as shown in FIG. 7(*c*) and FIG. 8, the image fixing operations are performed in the modules TM, MM and LM simultaneously, and in the sheet-discharge-side conveyance system B the change-over gates are suitably operated, so that first the recording sheet (1) recorded in the top module TM is delivered to the discharge tray 34, next the recording sheet (2) recording in the middle module MM is delivered to the discharge tray 34, and lastly the recording sheet (3) processed in the low module LM is delivered to the discharge tray 34. That is, the sheets (1), (2) and (3) are discharged one after another in the stated order.

Thereafter, with the timing indicated in FIG. 8, recording sheets (4), (5) and (6) are supplied to the recording modules TM, MM and LM, and the printing operations are carried out in the same manner as described above.

In FIG. 8 the two-dot chain lines indicate the rear edges of the recording sheets (1) and (3). This means that a predetermined gap is held between adjacent recording sheets P and the recording sheets P are smoothly conveyed.

3-b) Both-side print mode

In this mode, in the recording modules M, an image according to the one and the same image data is printed on the first sides of recording sheets P, and thereafter an image different from the firstly mentioned image is printed on the second sides of the recording sheets P.

When recording sheets (1), (2) and (3) are supplied from the sheet supply cassette 14 in the stated order, as shown in the parts (*a*) and (*b*) of FIG. 9, then those recording sheets reach the register gates 65 in the respective recording modules M simultaneously, so that the image is recorded on the first sides of the recording sheets (1), (2) and (3) by the respective recording modules M simultaneously.

Thereafter, the recording sheets (1), (2) and (3) passing through the respective fixing units 5, as shown in FIGS. 9(*c*) and 9(*d*), are delivered into the intermediate tray 17 through the sheet return path 26 and the sheet turn-over path 27 in the sheet supplying unit 10 in the reverse order; i.e., (3), (2) and (1).

The above-described operations are repeatedly carried out until the number of recording sheets whose first sides are printed in this manner reaches the predetermined value. All the recording sheets thus printed are accommodated in the intermediate tray 17.

Thereafter, the recording sheets P thus held in the intermediate tray 17, as shown in FIG. 9(e), are supplied in the order of (1)', (2)' and (3)' with predetermined timing, thus reaching the register gates 65 in the respective recording modules M at the same time. Then, in the recording modules M, an image according to another image data is printed on the second sides of the recording sheets P simultaneously. After the images formed on the recording sheet are fixed, these recording sheets are delivered into the discharge tray 34 in the order of (1)', (2)' and (3)'. In view of the collection of the recording sheets P at the discharge tray, it is desirable that the recording sheets be delivered into it inside out.

In the both-side print mode, of the image data the relationships of the page data are as indicated in the following

TABLE 1

| DISCHARGING POSTURE RECORDING ORDER | INSIDE OUT | | OUTSIDE OUT | |
|---|---|---|---|---|
| | FIRST | SECOND | FIRST | SECOND |
| TM | 1 | 2 | 6 | 5 |
| MM | 3 | 4 | 4 | 3 |
| LM | 5 | 6 | 2 | 1 |

IV. Modifications (a) Image data supply control system

In the above-described embodiment, one and the same image data is supplied to the recording modules M; however, the invention is not limited thereto or thereby. That is, different image data may be applied to the different recording modules M. In this case, for instance in the image data supply control system shown in FIG. 6 the FIFO register 134 and the gap memory 135 of each ROS control system 130 are employed as page memories. The destinations of different image data supplied in a serial mode are determined by the gate circuit 120, and the image data are stored in the page memories temporarily. Thereafter, density codes according to the image data are read out of the page memories with suitable timing, so that image recording operations are carried out in the recording modules M substantially at the same time.

In the both-side print mode, the order of receiving the recording sheets P into the intermediate tray 17 is reverse to the order of supplying them, and therefore it is necessary to control the recording sheet conveyance sequence so that the page data of the image data may not be shifted.

(b) Layout of the discharge tray

In the above-described embodiment, the discharge tray 34 is provided for the uppermost recording unit 30*a*; however, the invention is not limited thereto or thereby. That is, it may be provided for the lowermost recording unit 130*c*.

Figure 10C:
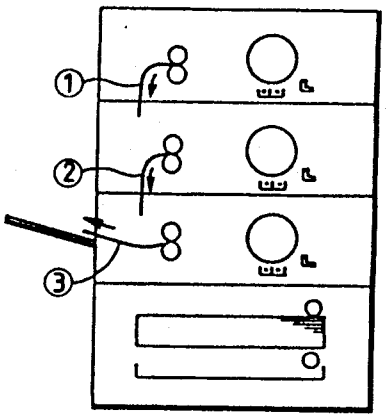
FIGS. 10(*a*) through 10(*c*) are simplified explanatory diagrams for a description of one modification of the operation of the one-side print mode.
Figure 10B:
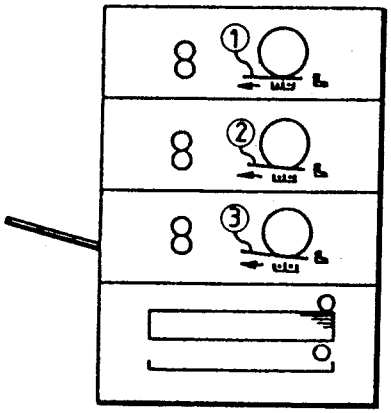
Figure 10A:
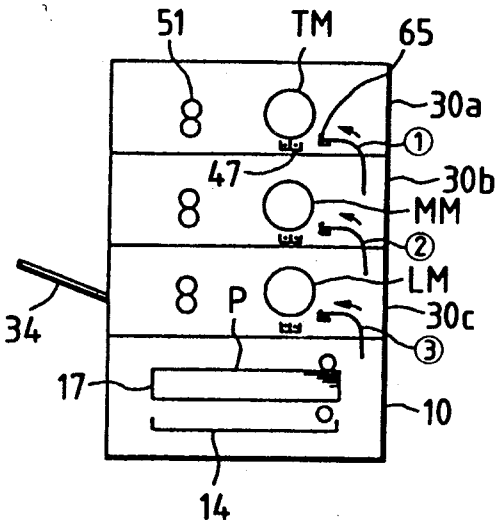

In this case, even in the one-side print mode, the printing sheets P supplied from the sheet supplying tray 14 in the order of (1), (2) and (3) with predetermined timing are discharged into the discharge tray 34 in the order of (3), (2) and (1) after being printed by the respective modules M, as shown in FIGS. 10(*a*) through 10(*c*).

In the both-side print mode, of the image data the relationships of page data are as indicated in the following Table 2:

TABLE 2

| DISCHARGING POSTURE RECORDING ORDER | INSIDE OUT | | OUTSIDE OUT | |
|---|---|---|---|---|
| | FIRST | SECOND | FIRST | SECOND |
| TM | 5 | 6 | 2 | 1 |
| MM | 3 | 4 | 4 | 3 |
| LM | 1 | 2 | 6 | 5 |

Second Embodiment

Figure 11:
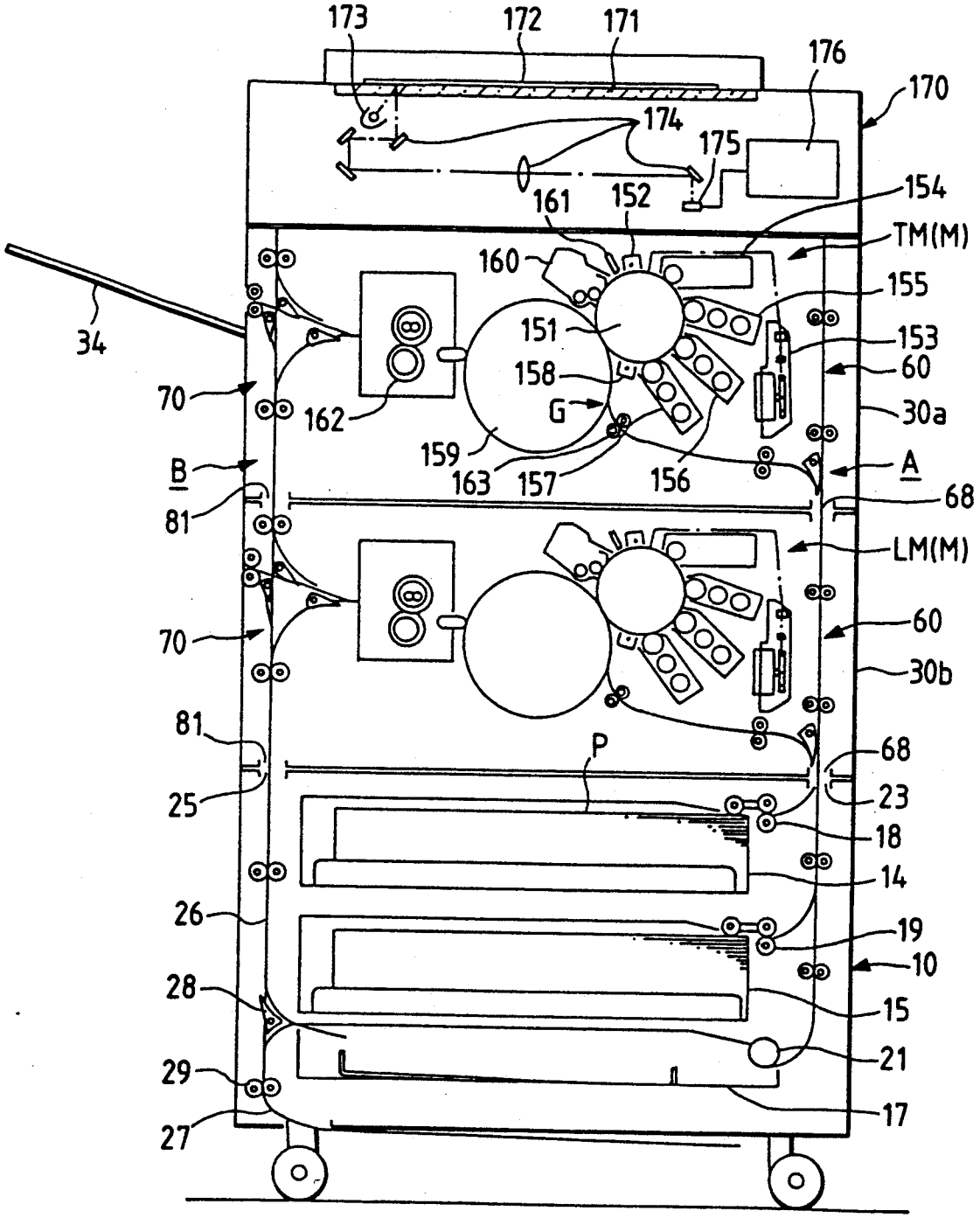
FIG. 11 is a sectional view showing the arrangement of a full-color copying machine constructed according to a second embodiment of the invention.

FIG. 11 shows a second embodiment of the invention which is a full-color copying machine. The copying machine comprises: a sheet supplying unit 10, a two-tiered recording unit 30 (more specifically recording units 30*a* and 30*b*) mounted on the sheet supplying unit 10; and an image reading unit employed as an IIT. A discharge tray 34 is coupled to the upper recording unit 30*a*.

In the second embodiment, the sheet supplying unit 10 is fundamentally equal in construction to that in the above-described first embodiment; however, in order to reduce the height, the sheet supplying unit 10, unlike the one in the first embodiment, is not provided with the sheet supply cassette 17.

The recording unit 30 has the same sheet-supply-side divisional conveyance system 60 and the same sheet-discharge-side divisional conveyance system 70 as that in the first embodiment; however, its recording module M (more specifically a top module TM and a low module LM) is different in construction from that in the first embodiment.

In the second embodiment, each recording module M is to record a full-color image by electrophotographing, and, as shown in FIG. 11, is made up of the following elements: a photosensitive drum 151; a charging corotron 152 for charging the photo-sensitive drum 151 in advance; a ROS 153 for applying a light beam corresponding to density data D to the photo-sensitive drum 151; a first developing unit 154 for developing with black toner; second, third and fourth developing units 155, 156 and 157 which develop with cyan, magenta and yellow toners, respectively; a transfer pretreatment corotron 158; a transfer drum 159 which rotates while being in contact with the photo-sensitive drum 151 so that toner images in different colors are transferred from the photo-sensitive drum 151 onto the recording sheet P; a cleaner 160 for removing toner from the photo- sensitive drum 151; a discharging lamp 161 for discharging the photo-sensitive drum 151; and a fixing unit 162. In the second embodiment, the sheet-supply-side divisional conveyance system 60 has no register gate (65) nor conveying rollers (67) unlike that in the first embodiment; instead, in the sheet distribution path 63 a pair of register rolls 163 for supplying a recording sheet P are provided near the grip position of the transfer drum 159.

In the aforementioned image reading unit 170, an original 172 on the platen 171 is scanned with an exposure lamp 173, and the scanning beam is led to a full-color sensor 175 by means of an optical image forming system comprising mirrors and lenses. The output of the full-color sensor 175 is applied to an image data forming device 176, so that image data having density data D is formed according to the optical data applied to the full-color sensor 175.

The operation of the full-color copying machine thus constructed will be described.

It is assumed that the process speed of each color is 200 m/sec, and the speed of conveyance of a recording sheet P (laid laterally) of A4 size is 200 mm/sec.

Figure 12:
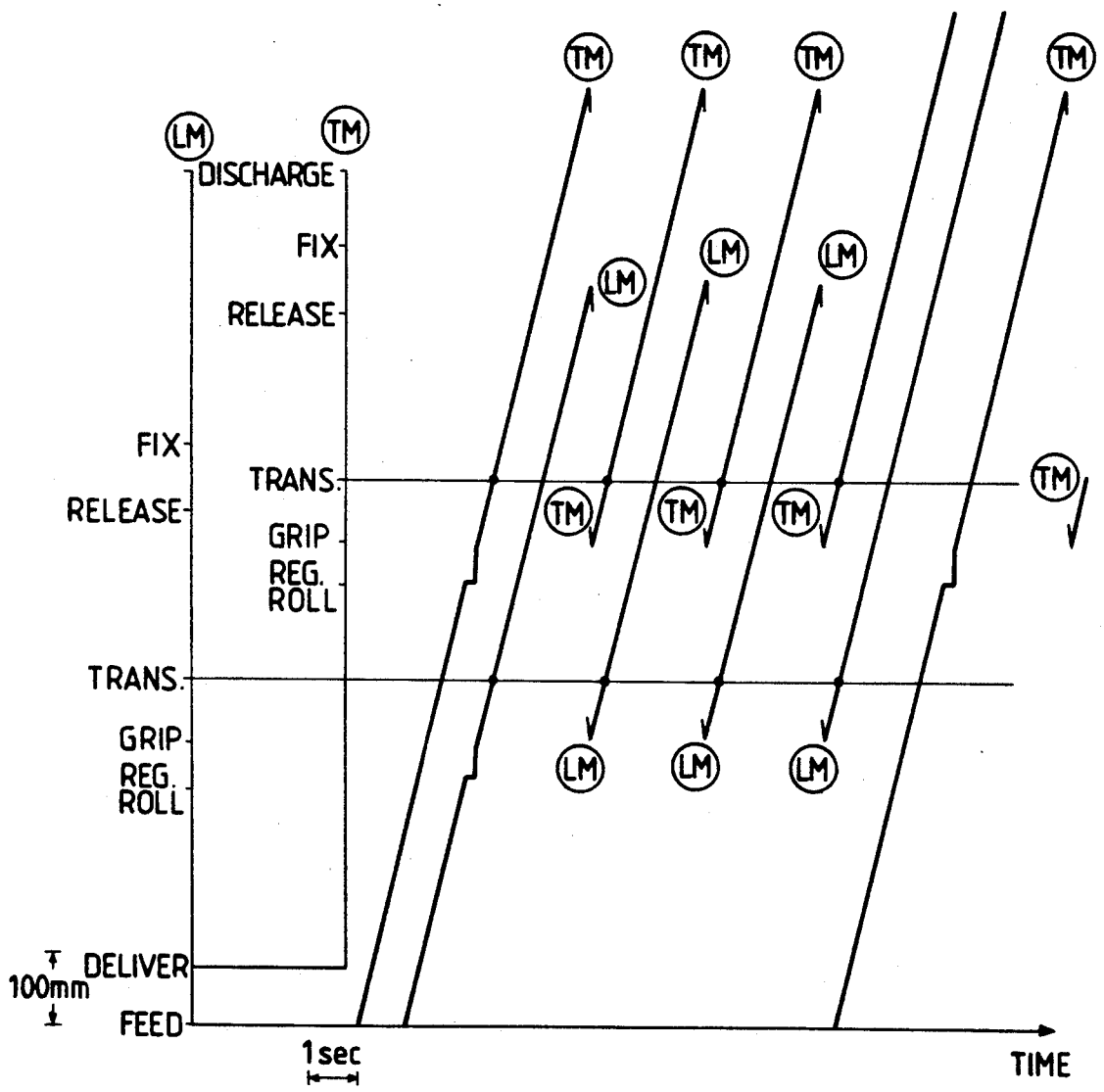
FIG. 12 is a time chart for a description of the operation in a one-side print mode.

In the one-side print mode, the copying machine operates as follows: When recording sheets P are successively supplied from the sheet supplying unit 10, as shown in FIG. 12 they are detained at the respective register rolls 163 temporarily and then conveyed again, so that they are held at the grip positions of the transfer drums 159 in the respective modules M at the same time. In each module M, a yellow toner image, cyan toner image, magenta toner image and black toner image are successively formed on the drum 151, and they are transferred onto the recording sheet P on the transfer drum every four revolutions of the photo-sensitive drum 151.

Thereafter, in the recording modules M, the recording sheets P are released from the transfer drums 159 simultaneously, and are passed through the respective fixing units 161 at the same time.

The recording sheet P printed by the top module TM is first conveyed to the discharge tray 34, and next the recording sheet P printed by the low module LM is delivered to the discharge tray 34.

In the second embodiment, the recording operations of the modules M are the same in timing sequence; however, the timing sequence may be so modified that the recording operations of the modules M are carried out with the time of delay corresponding to one through three revolutions of the photo-sensitive drum 151.

Third Embodiment

Figure 13:
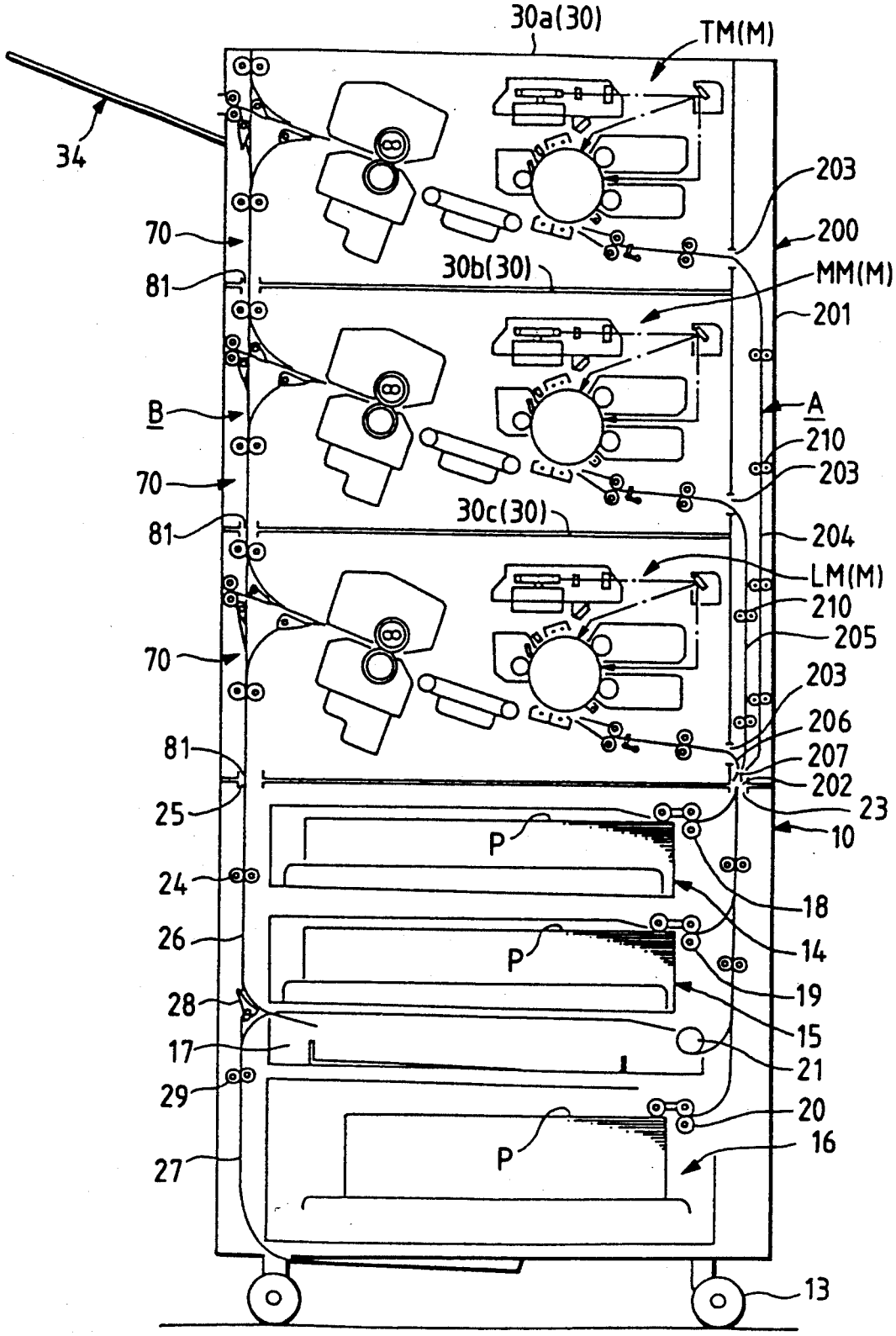
FIG. 13 is a sectional view showing the arrangement of a printer constructed according to a third embodiment of the invention.

A third embodiment of the invention, a printer shown in FIG. 13 is substantially equal in fundamental construction to the first embodiment described above; however, it should be noted that the third embodiment is different from the first embodiment in that the sheet-supply-side conveyance system A is one unit.

That is, the sheet-supply-side conveyance unit 20 has a casing 201, which has a communication openings 202 and 203 provided for the sheet supply opening 23 of the sheet supplying unit 10 and the sheet distribution paths 62 of the recording units 30, respectively. Exclusive conveyance paths 204, 205 and 206 are provided in the region from the communication opening 202 to the communication opening 203. A plurality of pairs of conveying rollers 210 are provided along each of the exclusive conveyance paths 204, 205 and 206. A select guide 207 is provided for the exclusive conveyance paths 204 through 206 near the communication opening 202, to select one of the conveyance paths 204 through 206.

Figure 14:
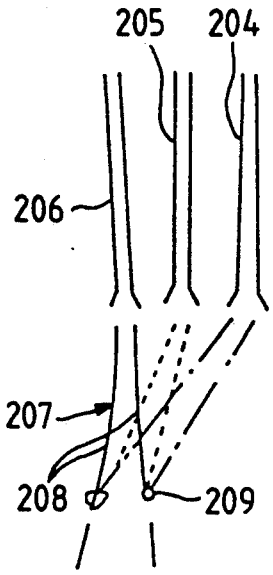
FIG. 14 is an explanatory diagram showing the construction of a select guide.

In the third embodiment, as shown in FIG. 14, the select guide 207 comprises a pair of guide boards 208 supported swingably on shafts 209, so that the pair of guide boards 208 are aligned with one of the exclusive conveyance paths 204 through 206 by driving means such as a solenoid.

In the third embodiment thus constructed, the recording sheets P supplied from the sheet supplying unit 10 are forwarded to the exclusive conveyance paths 204, 205 and 206 by means of the select guide 207. Therefore, even if the conveyance gap of the recording sheets P supplied from the sheet supplying unit 10 is not accurate, the difficulty can be positively prevented that the recording sheets P are caught in the conveyance paths.

Figure 15:
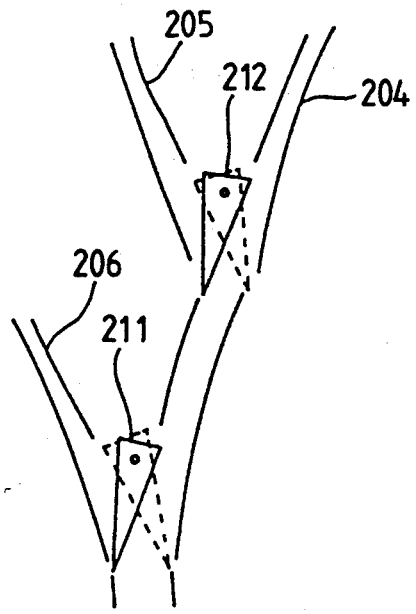
FIG. 15 is an explanatory diagram showing one modification of the select guide.

In the third embodiment, the select guide 207 is used to select any one of the exclusive conveyance paths 204, 205 and 206; however, the invention is not limited thereto or thereby. For instance, as shown in FIG. 15 two change-over gates 211 and 212 may be employed so as to select any one of the exclusive conveyance paths 204 through 206.

Fourth Embodiment

Figure 16:
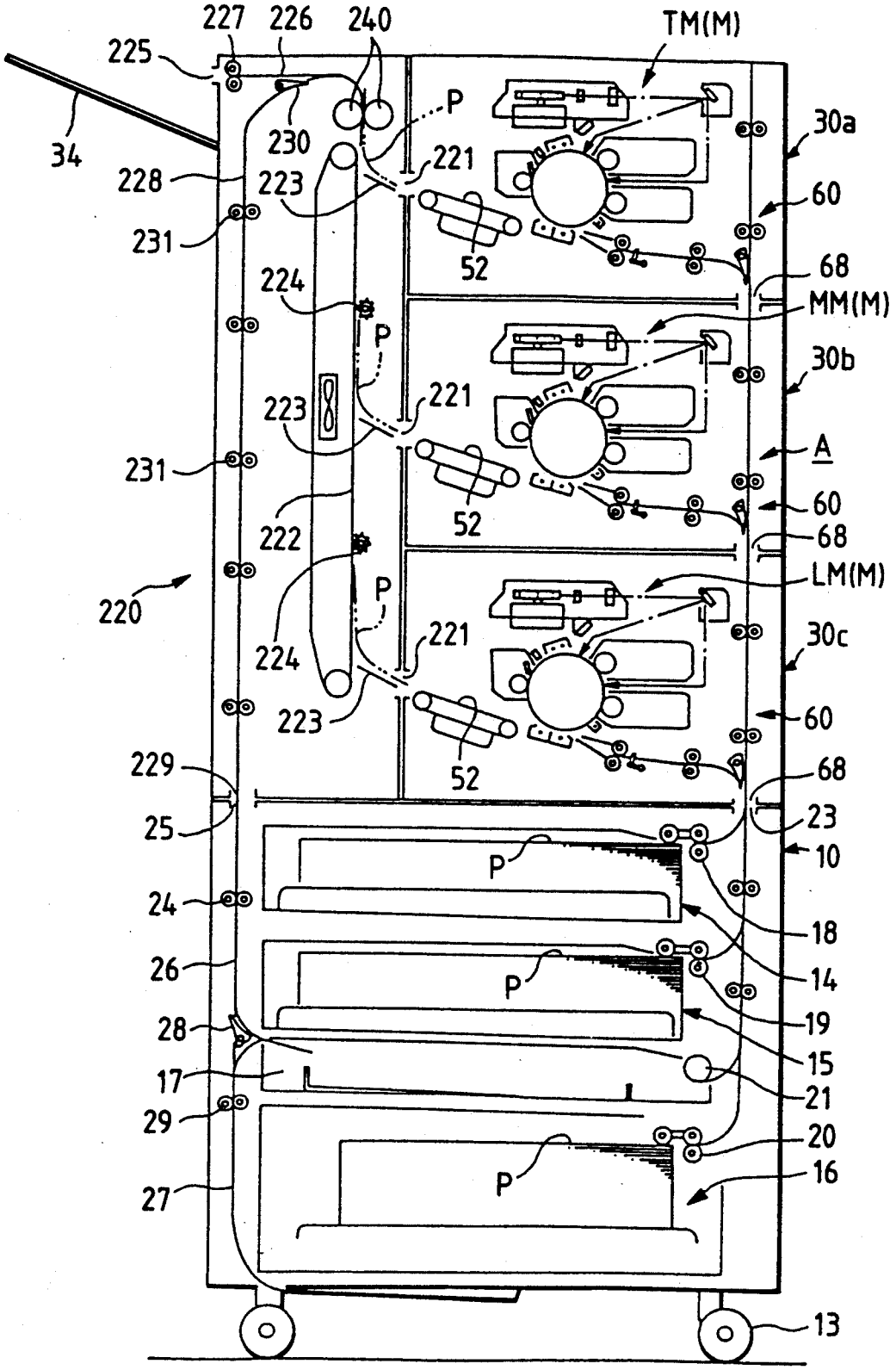
FIG. 16 is an explanatory diagram showing the arrangement of a printer constructed according to a fourth embodiment of the invention.

FIG. 16 shows a fourth embodiment of the invention, a printer. The fourth embodiment is substantially equal in fundamental construction to the first embodiment; however, the fourth embodiment is different from the first embodiment in that instead of the plural fixing units 51, a common fixing unit is employed, and the sheet-discharge-side conveyance system B is provided as one unit. In the fourth embodiment, its recording unit 30 is obtained by removing the fixing unit 51 and the sheet-discharge-side divisional conveyance system 70 from the recording unit in the first embodiment.

In the aforementioned sheet-discharge-side conveyance unit 220, communication openings 221 are provided near the outlets of the conveying belts 52 in the recording units 30, a vacuum conveying belt 222 is laid vertically, and guide plates 223 extended obliquely upwardly from the communication openings 221 towards the vacuum conveying belt 222. Furthermore in the sheet-discharge-side conveyance unit 220, a predetermined number of star wheels 224 are provided along the conveying surface of the vacuum conveying belt 222, and the common fixing unit 240 is disposed above the vacuum conveying belt 222. The sheet- discharge-side conveyance unit 220 is provided with a sheet discharge conveyance path 226 extended from near the outlet of the common fixing unit 240 to a sheet discharge outlet 225. A pair of discharge rollers 227 are provided at the outlet of the sheet discharge conveyance path 226. In addition, a sheet return conveyance path 228 branching from the middle of the sheet discharge conveyance path 226 is extended downwardly and connected to a communication opening 229 communicating with the sheet return opening 25. A change-over gate 230 is provided a the branching point of the sheet return conveyance path 228 from the sheet discharge conveyance path 226, to select a targeted path. Further in FIG. 16, reference numeral 231 designates pairs of conveying rollers arranged along the sheet return conveyance path 228.

The operation of the fourth embodiment, the printer, will be described.

In the one-side print mode, the printer operates as follows: When the recording sheets P are supplied successively from the sheet supplying unit 10, they are printed by the respective recording modules M simultaneously, and are then delivered to the sheet-discharge-side conveyance unit 220 with the same timing.

The recording sheets P thus printed are forwarded along the guide plates 223 to the vacuum conveying belt 222, so that they are conveyed by the latter 222. In this operation, the toner images not developed will not be brought into contact with the vacuum conveying belt 222, and accordingly the toner images will not be deformed. Since the star wheels 224 prevent the recording sheets P from floating, the recording sheets are conveyed smoothly.

The recording sheets P thus printed are passed through the common fixing unit 240 in the order in which they are discharged from the top module TM, the middle module MM and the low module LM. Finally they are delivered into the discharge tray 34.

In the both-side print mode, the recording sheets whose first sides are printed are forwarded through the sheet return conveyance path 228 into the intermediate tray 17 in the sheet supplying unit 10, and thereafter the second sides of the recording sheets P are printed.

As was described above, in the image recording apparatus of the present invention, the recording sheets supplied successively from the sheet supplying means are distributed to the plurality of recording modules, and images according to image data supplied are recorded on the recording sheets by the recording modules substantially simultaneously. Therefore, the image recording performance can be substantially improved without needing to increase the process speed of each recording module. Furthermore, in the apparatus, the plurality of recording modules are operated simultaneously with the sheet supplying means used in common. Accordingly, when compared with the apparatus in which sheet supplying means are provided for a plurality of recording modules, respectively, the apparatus of the invention is economical in the use of installation space, and can simplify the detection of the presence or absence, the numbers, and sizes of recording sheets. In addition, the shift of the image position can be corrected with ease, because the correction can be achieved by adjusting the write position of each recording module.

In the image recording apparatus of the present invention, the recording sheets printed by the plurality of recording modules are delivered into the predetermined sheet discharge section. Therefore, the collection of recording sheets which have been printed can be simplified.

In the image recording apparatus of the present invention, the recording modules and the sheet conveyance system's divisional parts equal in arrangement form recording units, respectively. Hence, by stacking the recording units suitably, the apparatus can be simplified in arrangement, and the specification of the apparatus can be changed readily.

In the image recording apparatus of the present invention, the recording modules and the sheet distributing means, or the recording modules, the sheet distributing means and the sheet collecting means are provided on the sheet supplying means. The installation space for the apparatus can be determined from the installation space required for the sheet supplying means only; thus, the overall installation space for the apparatus is decreased.

In the image recording apparatus of the present invention, the sheet supplying means is suitably designed in arrangement, and the recording sheets the first sides of which have been recorded are returned to the sheet supplying means, for realization of a both-side recording operation.

In the image recording apparatus of the present invention, the sheet distributing means has the conveyance paths, connected separately to the recording modules. Therefore, even if the recording sheet conveyance gap is not correctly controlled, the difficulty can be positively prevented that the recording sheets are caught in the sheet conveyance path or paths; that is, it is unnecessary to control the recording sheet conveyance gap to a high degree of accuracy.

In the image recording apparatus of the present invention, the recording modules are of electrophotographing type, and the common fixing means is used for fixing the recording sheets printed thereby. When compared with the apparatus in which fixing means is provided for each of the recording modules, the apparatus of the present invention has greatly reduced power consumption, and therefore can use a power source having ordinary specifications.

What is claimed is:

1. An image recording apparatus comprising:

a plurality of recording modules for substantially simultaneously recording on recording sheets images according to image data supplied thereto;

image data supplying means for supplying images to said recording modules;

sheet supplying means for successively supplying said recording sheets to said recording modules;

sheet distributing means for distributing said recording sheets thus supplied successively by said sheet supplying means to said recording modules; and sheet collecting means, arranged on top of said sheet supplying means, for successively delivering said recording sheets recorded by said recording modules to a predetermined sheet discharge section, wherein said recording modules and said sheet distributing means are arranged on top of said sheet supplying means.

2. An image recording apparatus comprising:

a plurality of recording modules for substantially simultaneously recording on recording sheets images according to recording modules;

image data supplying means for supplying and recording sheets to said recording modules;

sheet distributing means for distributing said recording sheets thus supplied successively by said sheet supplying means to said recording modules;

an intermediate sheet supply section which, in a both-side record mode, turns over said recording sheets the first sides of which have been recorded by said recording modules and accommodates said recording sheets thus turned over, and supplies said recording sheets thus accommodated to said recording modules again; and sheet returning means for conveying, in both-side record mode, said recording sheets the first sides of which have been recorded by said recording modules to said intermediate sheet supply section.

3. An image recording apparatus comprising:

a plurality of recording modules for substantially simultaneously recording on recording sheets images according to image data supplied thereto;

image data supplying means for supplying images to said recording modules;

sheet supplying means for supplying said recording sheets to said recording modules; and sheet distributing means for distributing said recording sheets thus supplied successively by said sheet supplying means to said recording modules, wherein when said recording modules are of an electrophotographing type, one and the same fixing means is used for fixing toner images on said recording sheets.

* * * * *

UNITED STATES PATENT AND TRADEMARK OFFICE

CERTIFICATE OF CORRECTION

PATENT NO. : 5,208,640
DATED : May 04, 1993
INVENTOR(S) : Kiyoshi Horie et al.

It is certified that error appears in the above-indentified patent and that said Letters Patent is hereby corrected as shown below:

Claim 2, column 16, line 46, change "recording modules;" to --image data supplied thereto;--.

Claim 2, column 16, line 47, change "and re-" to --images to said recording modules--.

Claim 2, column 16, line 48, delete in its entirety and insert the new paragaraph --sheet supplying means for supplying said recording sheets to said recording modules; and --.

Signed and Sealed this

Twenty-fourth Day of January, 1995

*Attest:*

Bruce Lehman

BRUCE LEHMAN

*Attesting Officer*

*Commissioner of Patents and Trademarks*